US009366092B2

(12) United States Patent
Hutin et al.

(10) Patent No.: US 9,366,092 B2
(45) Date of Patent: Jun. 14, 2016

(54) INTERFACE AND METHOD FOR WELLBORE TELEMETRY SYSTEM

(75) Inventors: Remi Hutin, New Ulm, TX (US); David Santoso, Klanagawa (JP); Lise Hvatum, Katy, TX (US); Christopher P. Reed, West University Place, TX (US); Raghu Madhavan, Kanagawa-Ken (JP); Jean-Marc Follini, Houston, TX (US)

(73) Assignee: INTELLISERV, LLC, Houston, TX (US)

( * ) Notice: Subject to any disclaimer, the term of this patent is extended or adjusted under 35 U.S.C. 154(b) by 1511 days.

(21) Appl. No.: 11/995,027

(22) PCT Filed: Aug. 3, 2006

(86) PCT No.: PCT/US2006/030326

§ 371 (c)(1),
(2), (4) Date: Mar. 10, 2009

(87) PCT Pub. No.: WO2007/016687

PCT Pub. Date: Feb. 8, 2007

(65) Prior Publication Data

US 2010/0116550 A1 May 13, 2010

Related U.S. Application Data

(60) Provisional application No. 60/705,326, filed on Aug. 4, 2005, provisional application No. 60/708,561, filed on Aug. 16, 2005.

(51) Int. Cl.
*E21B 47/01* (2012.01)
*E21B 47/12* (2012.01)

(Continued)

(52) U.S. Cl.
CPC ..... *E21B 17/003* (2013.01); *E21B 17/028* (2013.01); *E21B 47/12* (2013.01); *E21B 47/122* (2013.01)

(58) Field of Classification Search
USPC ..... 175/40, 50, 45; 166/250.01, 250.11, 66
See application file for complete search history.

(56) References Cited

U.S. PATENT DOCUMENTS 4,121,193 A 10/1978 Denison
4,297,880 A 11/1981 Berger (Continued)

FOREIGN PATENT DOCUMENTS

EA 007962 B1 2/2007
GB 2419903 5/2006

(Continued)

OTHER PUBLICATIONS

Office Action dated Feb. 16, 2010 for Russian Patent Application No. 2008108088/03(008753), 9 pages.

(Continued)

*Primary Examiner* — David Andrews
(74) *Attorney, Agent, or Firm* — Conley Rose, P.C.

(57) ABSTRACT

A system for use in a drilling operation that includes uphole electronic equipment and a drill string suspended in an earth borehole, a section of wired drill pipe that is part of a communication link between a downhole tool and the uphole electronic equipment, an interface for communicating between the section of wired drill pipe and a communication source/destination. The system includes a housing having a generally cylindrical outer shape which has a passage there through. The housing has a WDP end connectable to the section of wired drill pipe and a further end connectable to the communication source/destination. The system also includes a WDP circuit module disposed within the housing. The WDP circuit module electrically coupleable with the wired drill pipe section. The system includes a further circuit module, disposed within the housing, which is electrically coupled with the WDP circuit module and electrically coupleable with the communication source/destination.

41 Claims, 11 Drawing Sheets

(51) Int. Cl.

| | |
|---|---|
| ***E21B 17/00*** | (2006.01) |
| ***E21B 17/02*** | (2006.01) |

(56) References Cited

U.S. PATENT DOCUMENTS

| | | | | |
|---|---|---|---|---|
| 4,606,415 | A | 8/1986 | Gray, Jr. et al. | |
| 5,184,508 | A | 2/1993 | Desbrandes | |
| 5,469,736 | A | 11/1995 | Moake | |
| 5,513,528 | A | 5/1996 | Holenka et al. | |
| 5,887,657 | A | 3/1999 | Bussear et al. | |
| 5,934,371 | A | 8/1999 | Bussear et al. | |
| 5,959,547 | A | 9/1999 | Tubel et al. | |
| 5,971,072 | A | 10/1999 | Huber et al. | |
| 6,233,524 | B1 | 5/2001 | Harrell et al. | |
| 6,252,518 | B1 | 6/2001 | Laborda | |
| 6,374,913 | B1 | 4/2002 | Robbins et al. | |
| 6,415,231 | B1 | 7/2002 | Hebert | |
| 6,415,877 | B1 | 7/2002 | Fincher et al. | |
| 6,615,933 | B1 | 9/2003 | Eddison | |
| 6,641,434 | B2 | 11/2003 | Boyle et al. | |
| 6,648,081 | B2 | 11/2003 | Fincher et al. | |
| 6,648,082 | B2 | 11/2003 | Schultz et al. | |
| 6,659,197 | B2 | 12/2003 | Cooper | |
| 6,670,880 | B1 | 12/2003 | Hall et al. | |
| 6,688,396 | B2 | 2/2004 | Floerke et al. | |
| 6,712,160 | B1 | 3/2004 | Schultz et al. | |
| 6,717,501 | B2 | 4/2004 | Hall et al. | |
| 6,722,450 | B2 | 4/2004 | Schultz | |
| 6,725,162 | B2 | 4/2004 | Edwards et al. | |
| 6,732,052 | B2 | 5/2004 | MacDonald | |
| 6,761,230 | B2 | 7/2004 | Cross et al. | |
| 6,816,082 | B1 | 11/2004 | Laborde | |
| 6,821,147 | B1 | 11/2004 | Hall et al. | |
| 6,830,467 | B2 | 12/2004 | Hall et al. | |
| 6,844,498 | B2 | 1/2005 | Hall et al. | |
| 6,854,532 | B2 | 2/2005 | Fincher et al. | |
| 6,868,920 | B2 | 3/2005 | Holeit et al. | |
| 6,888,473 | B1 | 5/2005 | Hall et al. | |
| 6,909,567 | B2 | 6/2005 | McClellan et al. | |
| 6,909,667 | B2 * | 6/2005 | Shah et al. | 367/83 |
| 6,950,034 | B2 | 9/2005 | Pacault et al. | |
| 6,986,282 | B2 | 1/2006 | Cigienec et al. | |
| 7,017,662 | B2 | 3/2006 | Schultz et al. | |
| 7,044,237 | B2 | 5/2006 | Leuchtenberg | |
| 7,062,959 | B2 | 6/2006 | Kurkjian et al. | |
| 7,082,821 | B2 | 8/2006 | Chen et al. | |
| 7,096,961 | B2 | 8/2006 | Clark et al. | |
| 7,139,218 | B2 | 11/2006 | Hall et al. | |
| 7,174,975 | B2 | 2/2007 | Krueger et al. | |
| 7,201,221 | B2 | 4/2007 | Tubel et al. | |
| 7,204,324 | B2 | 4/2007 | Gleitman et al. | |
| 7,207,396 | B2 | 4/2007 | Hall et al. | |
| 7,224,288 | B2 | 5/2007 | Hall et al. | |
| 7,253,745 | B2 | 8/2007 | Hall et al. | |
| 7,270,185 | B2 | 9/2007 | Fontana et al. | |
| 7,284,903 | B2 | 10/2007 | Hartog | |
| 7,298,286 | B2 | 11/2007 | Hall | |
| 7,299,867 | B2 | 11/2007 | Hall et al. | |
| 7,311,142 | B2 | 12/2007 | Fisseier et al. | |
| 7,382,273 | B2 | 6/2008 | Hall et al. | |
| 7,413,021 | B2 | 8/2008 | Madhavan et al. | |
| 7,428,924 | B2 | 9/2008 | Patel | |
| 8,164,476 | B2 | 4/2012 | Hache et al. | |
| 2002/0096363 | A1 * | 7/2002 | Evans et al. | 175/41 |
| 2003/0147360 | A1 | 8/2003 | Nero et al. | |
| 2004/0039466 | A1 | 2/2004 | Lilly et al. | |
| 2004/0104797 | A1 | 6/2004 | Hall et al. | |
| 2004/0113808 | A1 | 6/2004 | Hall et al. | |
| 2004/0145492 | A1 | 7/2004 | Hall et al. | |
| 2004/0150532 | A1 | 8/2004 | Hall et al. | |
| 2004/0217880 | A1 | 11/2004 | Clark et al. | |
| 2005/0001735 | A1 | 1/2005 | Hall et al. | |
| 2005/0024231 | A1 | 2/2005 | Fincher et al. | |
| 2005/0087368 | A1 * | 4/2005 | Boyle et al. | 175/57 |
| 2005/0092488 | A1 | 5/2005 | Rodet et al. | |
| 2005/0092499 | A1 | 5/2005 | Hall et al. | |
| 2005/0161215 | A1 | 7/2005 | Hall et al. | |
| 2005/0173128 | A1 | 8/2005 | Hall et al. | |
| 2005/0194182 | A1 | 9/2005 | Rodney et al. | |
| 2005/0194184 | A1 | 9/2005 | Gleitman | |
| 2005/0200498 | A1 | 9/2005 | Gleitman | |
| 2005/0284663 | A1 | 12/2005 | Hall et al. | |
| 2006/0065305 | A1 | 3/2006 | Nojiri et al. | |
| 2006/0065395 | A1 * | 3/2006 | Snell | 166/255.2 |
| 2006/0065402 | A9 | 3/2006 | Fontana et al. | |
| 2006/0157282 | A1 | 7/2006 | Tilton et al. | |
| 2007/0017671 | A1 | 1/2007 | Clark et al. | |
| 2007/0029112 | A1 | 2/2007 | Li et al. | |
| 2007/0030167 | A1 | 2/2007 | Li et al. | |
| 2007/0030762 | A1 | 2/2007 | Huang et al. | |
| 2007/0045006 | A1 | 3/2007 | Krueger et al. | |
| 2007/0159351 | A1 | 7/2007 | Madhavan et al. | |
| 2007/0188344 | A1 | 8/2007 | Hache et al. | |
| 2007/0263488 | A1 | 11/2007 | Clark | |
| 2007/0272033 | A9 | 11/2007 | Jones | |
| 2008/0041576 | A1 | 2/2008 | Patel | |
| 2008/0106433 | A1 | 5/2008 | Madhavan et al. | |
| 2008/0135291 | A1 | 6/2008 | Hall et al. | |
| 2009/0014175 | A1 | 1/2009 | Peter | |

FOREIGN PATENT DOCUMENTS

| | | | |
|---|---|---|---|
| RU | 2040691 | C1 | 7/1995 |
| RU | 2140527 | | 10/1999 |
| RU | 2193656 | C1 | 11/2002 |
| WO | 9014497 | A2 | 11/1990 |
| WO | 9300597 | A1 | 1/1993 |
| WO | 2004085796 | A1 | 10/2004 |
| WO | 2007016687 | | 2/2007 |

OTHER PUBLICATIONS

Examination Report dated Oct. 24, 2008 for European Patent Office Patent Application No. 06 789 337.0-2315, 3 pages.

"Smart Drill Pipe—Revolutionizing the Industry," USDOE NETL Strategic Center for Natural Gas & Oil, Program Facts, Jul. 2005.

"Very High-Speed Drill String Communications Network," Novatek, Rocky Mountain E&P, Technology Transfer Workshop, Aug. 4, 2003.

Rogers et al., "Very High-Speed Drill String Communications Network: an Enabling Technology," 4 GasTIPS, Spring 2003.

"IntelliPipe Technology: Wired for Speed and Durability," USDOE NETL Publications Press Release, Jun. 5, 2003.

"DOE-Industry Breakthrough Turns Drilling System into Lightning Fast Computer Network," USDOE NETL Publications Press Release, Sep. 30, 2002.

S. Polczer, "Interfacing Earth: New Drill Pipe Transforms Telemetry," Nickle's Daily Oil Bulletin New Technology Magazine, v. 8, No. 8, Dec. 2002.

English translation of Russian Patent No. 2040691, C1, published Jul. 25, 1995, Feodos'yevich et al.

English translation of Russian Patent No. 2193656, published Nov. 27, 2002, Grigashkin et al.

Sperry Drilling Services, "PWD (Pressure White Drilling) Sensor", Aug. 2007 (2 pages).

Petrobras Emerging Well Technologies; by Placido, Joao Carlos Ribeiro, et al., Drilling & Well Technology, Oil & Gas Review, 2007 OTC Edition (4 pages).

IADE/SPE 112636; High Speed Telemetry Drill Pipe Network Optimizes Drilling Dynamics and Wellbore Placement, Ali, T. H., et al., 200B (8 pages).

IADE/SPE 112702. The Utilization of the Massive Amount of Real Time Data Acquired in Wired Drillpipe Operations, Olberg, et al., (13 pages).

IADC/SPE 115206, Evolution of Innovative Test Methodology for Evaluation or Hardfacing Materials in both Cased and Open Environments; Chan, Alvaro, et al., SPE International, 2008 (15 pages).

IADC/SPE 112740 Evolution of Drilling Programs and Complex Well Profiles Drive Development of Fourth-Generation Hardband Technology, Chan, Alvaro, et al 2008 (17 pages).

(56) References Cited

OTHER PUBLICATIONS

Russian Patent Application No. 2010137427 Office Action dated Nov. 19, 2012.
International Patent Application No. PCT/US2006/030326 International Search Report and Written Opinion dated Dec. 12, 2006.
W.J. MacDonald, "Four Different Systems udes for MWD," Oil & Gas J., pp. 115-124 (Apr. 3, 1978).
JP Patent Application No. 2008-525194 Office Action dated Aug. 1, 2011 (5 pages).
JP Patent Application No. 2008-525194 Office Action dated Feb. 7, 2013 (4 pages).
Indian Patent Application No. 570/CHENP/2008, First Examination Report dated Sep. 2, 2014, 2 pages.
Norwegian Patent Application No. 20080298 Office Action dated Feb. 17, 2015 (7 pages).

* cited by examiner

INTERFACE AND METHOD FOR WELLBORE TELEMETRY SYSTEM

PRIORITY CLAIMS AND RELATED APPLICATIONS

The present Application claims priority from U.S. Provisional Patent Application No. 60/705,326, filed Aug. 4, 2005, and also claims priority from U.S. Provisional Patent Application No. 60/708,561, filed Aug. 16, 2005, and both said U.S. Provisional Patent Applications are incorporated herein by reference. Also the present Application contains subject matter that relates to subject matter disclosed in copending U.S. patent application Ser. No. 11/498,845 and copending U.S. patent application Ser. No. 11/498,847.

FIELD OF THE INVENTION

The present invention relates to telemetry systems for use in wellbore operations. More particularly, the present invention relates to wellbore telemetry systems for passing signals between a surface processor unit and a downhole tool positionable in a wellbore penetrating a subterranean formation.

BACKGROUND OF THE INVENTION

Wellbores are drilled to locate and produce hydrocarbons. A downhole drilling tool with a bit at one end thereof is advanced into the ground via a drill string to form a wellbore. The drill string and the downhole tool are typically made of a series of drill pipes threadably connected together to form a long tube with the bit at the lower end thereof. As the drilling tool is advanced, a drilling mud is pumped from a surface mud pit, through the drill string and the drilling tool and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to provide communication between the surface and the downhole tool. Wellbore telemetry devices are typically used to allow, for example, power, command and/or communication signals to pass between a surface unit and the downhole tool. These signals are used to control and/or power the operation of the downhole tool and send downhole information to the surface.

Various wellbore telemetry systems may be used to establish the desired communication capabilities. Examples of such systems may include a wired drill pipe wellbore telemetry system as described in U.S. Pat. No. 6,641,434, an electromagnetic wellbore telemetry system as described in U.S. Pat. No. 5,624,051, an acoustic wellbore telemetry system as described in PCT Patent Application No. WO2004085796, the entire contents of which are hereby incorporated by reference. Other data conveyance or communication devices, such as transceivers coupled to sensors, may also be used to transmit power and/or data.

With wired drill pipe ("WDP") telemetry systems, the drill pipes that form the drill string are provided with electronics capable of passing a signal between a surface unit and the downhole tool. As shown, for example, in U.S. Pat. No. 6,641,434, such wired drill pipe telemetry systems can be provided with wires and inductive couplings that form a communication chain that extends through the drill string. The wired drill pipe is then operatively connected to the downhole tool and a surface unit for communication therewith. The wired drill pipe system is adapted to pass data received from components in the downhole tool to the surface unit and commands generated by the surface unit to the downhole tool. Further documents relating to wired drill pipes and/or inductive couplers in a drill string are as follows: U.S. Pat. No. 4,126,848, U.S. Pat. No. 3,957,118 and U.S. Pat. No. 3,807,502, the publication "Four Different Systems Used for MWD," W. J. McDonald, The Oil and Gas Journal, pages 115-124, Apr. 3, 1978, U.S. Pat. No. 4,605,268, Russian Federation Published Patent Application 2140527, filed Dec. 18, 1997, Russian Federation Published Patent Application 2,040,691, filed Feb. 14, 1992, WO Publication 90/14497A2, U.S. Pat. No. 5,052,941, U.S. Pat. No. 4,806,928, U.S. Pat. No. 4,901,069, U.S. Pat. No. 5,531,592, U.S. Pat. No. 5,278,550, and U.S. Pat. No. 5,971,072.

With the advent and expected growth of wired drill pipe technology, various types of circumstances will arise where it is necessary to connect a section of wired drill pipe to various types of uphole equipment or various types of tools or other downhole equipment. In some cases, the wired drill pipe may be incompatible with one or more components in the downhole tool and/or surface units.

It is, therefore, desirable to provide an interface to establish a communication link between a section of the wired drill pipe and the downhole tool and/or surface unit to facilitate communication between the downhole tool and a surface unit. It is further desirable to provide wellbore telemetry systems capable of providing added reliability, increased data rate, compatibility between a variety of downhole systems and increased power capabilities. Such a system is preferably capable of one or more of the following, among others: improving reliability, reducing communication failures, improving connectability, increase bandwidth, increase data rates, providing flexibility for a variety of downhole configurations and adapting wellbore telemetry tools to various wellsite configurations.

SUMMARY OF THE INVENTION

A form of the present invention has application for use in a drilling operation that includes uphole electronic equipment and a drill string suspended in an earth borehole, the drill string having at least one downhole tool thereon, the drill string also having a section of wired drill pipe that is part of a communication link between the downhole tool and the uphole electronic equipment. In accordance with an embodiment of the invention, an interface is provided for communicating between said section of wired drill pipe and a communication source/destination. [As defined herein, the communication source/destination can be any part of the communication link, between and including the uphole electronic equipment and the downhole tool. For example, without limitation, the communication source/destination can be the uphole electronic equipment or an uphole sub that is coupled with the uphole electronic equipment (in which case, the interface is sometimes referred to as an uphole interface), or the communication source/destination can be the downhole tool, a bottom hole assembly containing the dowhhole tool, or another section of WDP (in which case the interface is sometimes referred to as a downhole interface).] A housing is provided, the housing having a generally cylindrical outer shape and having a passage therethrough. The housing has a WDP end connectable to the section of wired drill pipe and a further end connectable to the communication source/destination. A WDP circuit module is disposed within the housing, the WDP circuit module being electrically coupleable with the wired drill pipe section. A further circuit module is also disposed within the housing, the further circuit module being electrically coupled with said WDP circuit module and electrically coupleable with the communication source/destination.

As previously noted, with the advent and expected growth of wired drill pipe technology, various types of circumstances will arise where it is necessary to connect a section of wired drill pipe to various types of uphole equipment or various types of tools or other downhole equipment. If and when usage of interfaces for wired drill pipe systems becomes more common, the number of different types of interfaces is expected to increase, by virtue of sections of WDP being connected to various types of uphole and downhole equipment. Accordingly, in the described embodiment of the present invention, interfaces are provided in an advantageous modular form. In this manner, it will be necessary to produce and stock less interfaces having specific pairs of endpoint characteristics. Also, modules can, if desired, be fabricated by different entities having particular expertise with regard to the module's electrical and mechanical composition as it relates, especially, to the external equipment to which the particular module's external end will ultimately be coupled.

Accordingly, in an embodiment of the invention, the WDP circuit module and the further circuit module are removably coupled, and the WDP circuit module and further circuit module are separately removable from the housing. In a form of this embodiment, the housing is comprised of two separable and connectable housing modules including a WDP housing module containing said WDP end of the housing and containing said WDP circuit module, and a further housing module containing said further end of the housing and containing said further circuit module.

In an embodiment of the invention, said further circuit module comprises a power source that provides power using an internal power module and/or a battery, and/or an external power source.

In an embodiment of the invention, at least one of said WDP circuit module and said further circuit module includes one or more of the following: a readout port, diagnostics circuitry, a controller, a real-time clock, and one or more sensors.

In an embodiment of the invention the passage in the housing comprises at least a partial central axial passage, and the WDP circuit module and further circuit module are mounted in the housing generally adjacent the central axial passage. In this embodiment, said further end includes a connector, electrically coupled with said further circuit module, for connection to the communication source/destination, said connector being axially within an annular passage that communicates with said partial central axial passage. Also in this embodiment, said connector further comprises an electronics module.

In a further embodiment of the invention, the passage in the housing comprises at least a partial annular passage, and one of said WDP circuit module and further circuit module are mounted in a central portion of the housing within said partial annular passage.

Further features and advantages of the invention will become more readily apparent from the following detailed description when taken in conjunction with the accompanying drawings.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
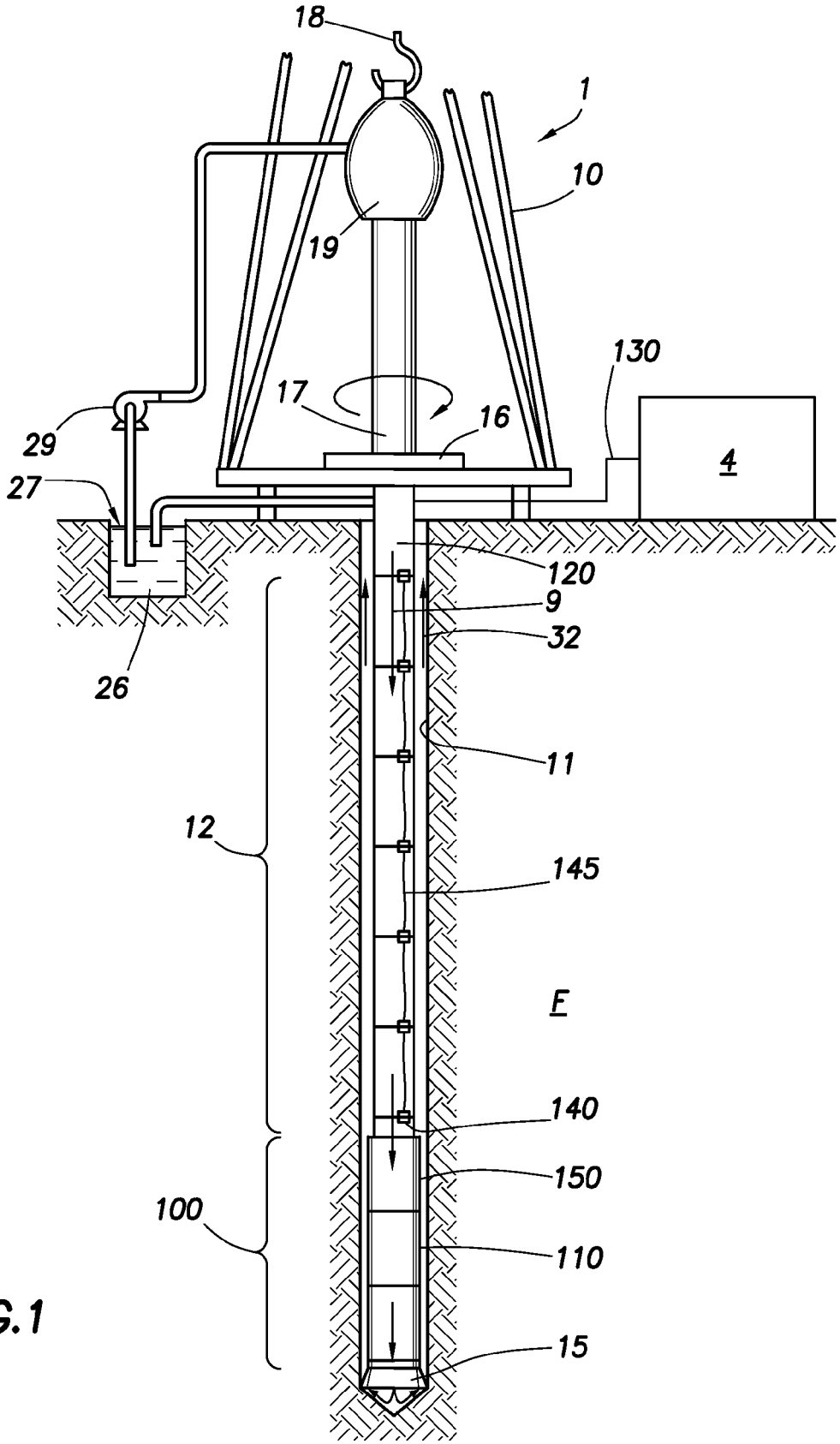
FIG. 1 is a schematic view, partially in cross-section of wellsite having a downhole tool deployed from a rig and into a wellbore via a drill string having a wired drill pipe telemetry system therein.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

FIG. 1 illustrates a wellsite system 1 with which the present invention can be utilized to advantage. In the illustrated system, a borehole 11 is formed by rotary drilling in a manner that is well known. Those of ordinary skill in the art given the benefit of this disclosure will appreciate, however, that the present invention also finds application in drilling applications other than conventional rotary drilling (e.g., mud-motor based directional drilling and rotary steerable systems), and is not limited to land-based rigs.

The downhole system 3 includes a drill string 12 suspended within the borehole 11 with a drill bit 15 at its lower end. The surface system 2 includes the land-based platform and derrick assembly 10 positioned over the borehole 11 penetrating a subsurface formation F. The assembly 10 includes a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook.

The surface system further includes drilling fluid or mud 26 stored in a pit 27 formed at the well site. A pump 29 delivers the drilling fluid 26 to the interior of the drill string 12 via a port in the swivel 19, inducing the drilling fluid to flow downwardly through the drill string 12 as indicated by the directional arrow 9. The drilling fluid exits the drill string 12 via ports in the drill bit 15, and then circulates upwardly through the region between the outside of the drill string and the wall of the borehole, called the annulus, as indicated by the directional arrows 32. In this manner, the drilling fluid lubricates the drill bit 15 and carries formation cuttings up to the surface as it is returned to the pit 27 for recirculation.

Below the drill string 12, there is a bottom hole assembly (BHA), generally referred to as 100, near the drill bit 15 (in other words, within several drill collar lengths from the drill bit). The bottom hole assembly includes capabilities for measuring, processing, and storing information, as well as communicating with the surface. The BHA 100 thus includes, among other things, an apparatus 110 for determining and communicating one or more properties of the formation F surrounding borehole 11, such as formation resistivity (or conductivity), natural radiation, density (gamma ray or neutron), and pore pressure.

The BHA 100 further includes drill collar 150 for performing various other measurement functions. Drill collar 150 houses a measurement-while-drilling (MWD) tool. The MWD tool further includes an apparatus (not shown) for generating electrical power to the downhole system. While a mud pulse system is depicted with a generator powered by the flow of the drilling fluid 26 that flows through the drill string 12 and the MWD drill collar 150, other power and/or battery systems may be employed.

Sensors may be provided about the wellsite to collect data, preferably in real time concerning the operation of the wellsite, as well as conditions at the wellsite. For example, such surface sensors may be provided to measure standpipe pressure, hookload, depth, surface torque, rotary rpm, among others. Downhole sensors may be disposed about the drilling tool and/or wellbore to provide information about downhole conditions, such as wellbore pressure, weight on bit, torque on bit, direction, inclination, drill collar rpm, tool temperature, annular temperature and toolface, among others. The information collected by the sensors are conveyed to the surface system, the downhole system and/or the surface control unit.

As shown in FIG. 1, an uphole interface 120 is provided at the uphole end of the drill string 12, a downhole interface is provided at the downhole end of the drill string 12. A wired drill pipe telemetry system 145 extends through the drill string 12. A communication link 130 is schematically depicted between the uphole interface and the surface unit 4. This configuration provides a communication link from the surface telemetry unit 4, through communication link 130, to uphole interface 120, through the wired drill pipe telemetry system, to interface 140 and to downhole tool (or BHA) 100.

While only one surface unit 4 at one wellsite 1 is shown, one or more surface units across one or more wellsites may be provided. The surface units may be linked to one or more surface interface using a wired or wireless connection via one or more communication lines 130. The communication topology between the surface interface and the surface system can be point-to-point, point-to-multipoint or multipoint-to-point. The wired connection includes the use of any type of cables (wires using any type of protocols (serial, Ethernet, etc.) and optical fibers. The wireless technology can be any kind of standard wireless communication technology, such as IEEE 802.11 specification, Bluetooth, zigbee or any non-standard RF or optical communication technology using any kid of modulation scheme, such as FM, AM, PM, FSK, QAM, DMT, OFDM, etc. in combination with any kind of data multiplexing technologies such as TDMA, FDMA, CDMA, etc. As one example, the antenna for the wireless connection can be put in the outer layer of the sub.

As shown in FIG. 1, the uphole interface is positioned at the uphole end of the wired drill pipe telemetry system. The uphole interface operatively connects the wired drill pipe telemetry system to the surface unit. As shown, a communication link is provided between the uphole interface and the surface unit. Optionally, in cases where the drill pipe extends above the rotary table and to the top drive, the interface sub may, for example, be positioned between the top drive and the wired drill pipe.

Figure 2B:
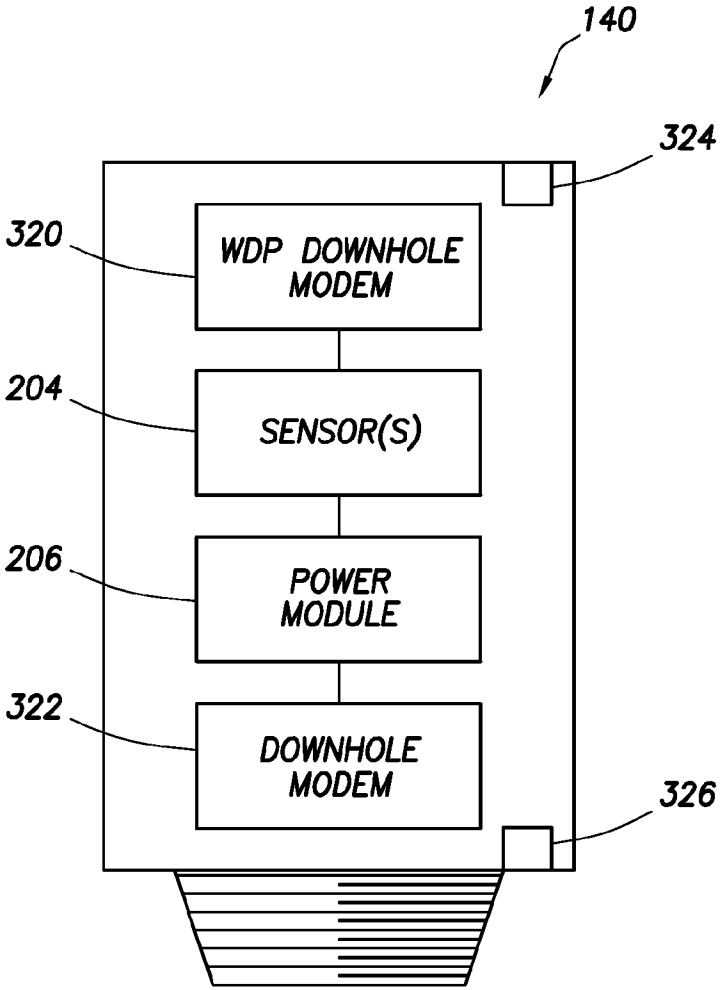
FIG. 2B is a schematic view of an embodiment of a downhole interface for passing signals between a surface unit and a wired drill pipe telemetry system.
Figure 2A:
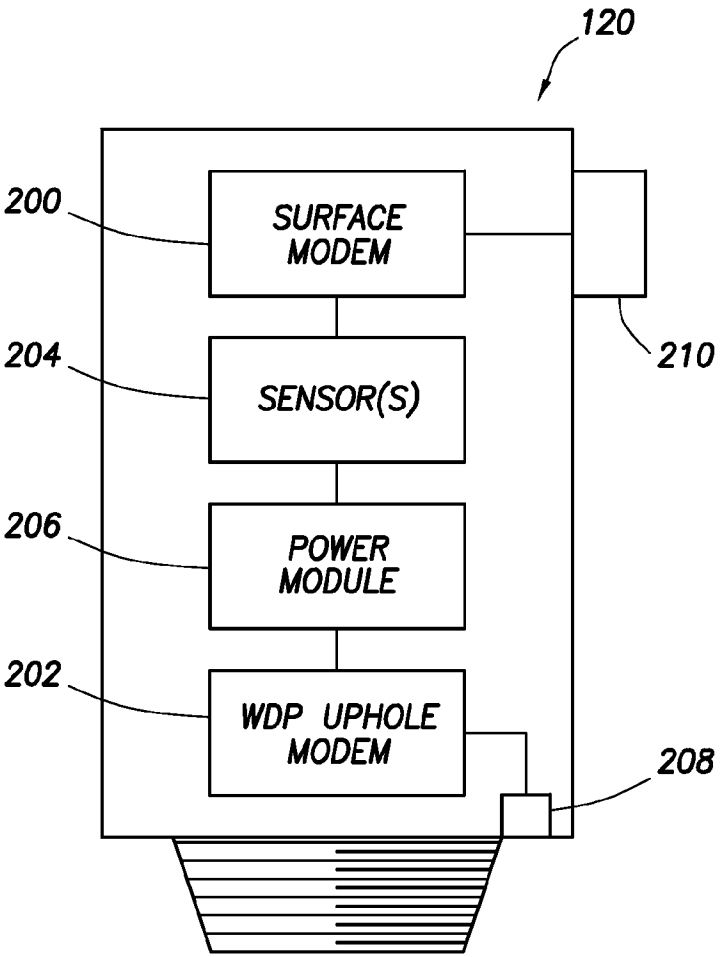
FIG. 2A is a schematic view of an embodiment of an uphole interface for passing signals between a surface unit and a wired drill pipe telemetry system.

The uphole interface 120 is shown in greater detail in FIG. 2A. The uphole interface is provided with a surface modem 200, a WDP uphole modem 202, sensors 204 and a power module 206. Typically, the uphole interface is housed in a drill pipe connectable to the uphole end of the drill string.

A WDP connector 208 is provided to operatively link the uphole interface with the wired drill pipe telemetry system. The connector may be an inductive coupler similar to the ones used on adjacent drill pipe in the WDP telemetry system. Alternatively, the connector may be a conductive connector or any other connector capable of communicating with the wired drill pipe telemetry system.

A surface connector 210 is also provided to operatively link the uphole interface with the surface unit. The surface connector may be a wired, wireless or optical connector adapted to link to the surface unit. The connector may provide for conductive, inductive, wired, wireless and/or optical communication with the surface unit.

One or more sensors 204 may be provided in the uphole interface 120 to measure various wellbore parameters, such as temperature, pressure (standpipe, mud telemetry, etc.), mud flow, noise, drilling mechanics (i.e., torque, weight on bit, acceleration, pipe rotation, etc.), etc. The measurements for drilling mechanics are performed at high sampling rates (typically 120 Hz). In addition, the pressure measurements are performed at higher sampling rates (typically 480 Hz) to facilitate telemetry demodulation. The sensors may be linked to an analog front end for signal conditioning and/or to a processor for processing and/or analyzing data. The sensors may also be used to perform diagnostics to locate faults in the wired drill pipe system, measure noise and/or characteristics of the wired drill pipe telemetry system and perform other diagnostics of the wellsite. The sensors may be integrated into the uphole interface 120 or placed along its outer diameter or inner diameter. Sensor data may be recorded in a memory device.

The uphole interface 120 may further be provided with a power module 206. The power module may generate power using any kind of power generator such as a turbine, piezoelectric, solar cell, etc., from any kind of potential energy source such as mud flow, rotation, vibration, RF signal, etc. The uphole interface may also be powered using batteries alone or as a backup of a power generator technique. The batteries may be rechargeable. Alternative power may be provided externally and stored or used by the uphole interface. In the wired drill pipe system, the uphole interface 120 may also be powered using a cable from a power generator located on or near the rig.

The surface modem 200 is adapted to communicate with one or more modems in the surface unit 4. The WDP uphole modem 202 is adapted to communicate with one or more modems, repeaters, or other interfaces in the downhole tool via the wired drill pipe telemetry system. Preferably, the modems provide bi-directional communications. Any kind of digital and analog modulation scheme may be used, such as biphase, frequency shift keying (FSK), quadrature phase shift-keying (QPSK), Quadrature Amplitude Modulation (QAM), discrete multi tone (DMT), etc. These schemes may be used in combination with any kind of data multiplexing technologies such as Time Division Multiplexing (TDM), Frequency Division Multiplexing (FDM), etc. The modem may include functionality for drill pipe diagnostics and downhole tool diagnostics.

Figure 3:
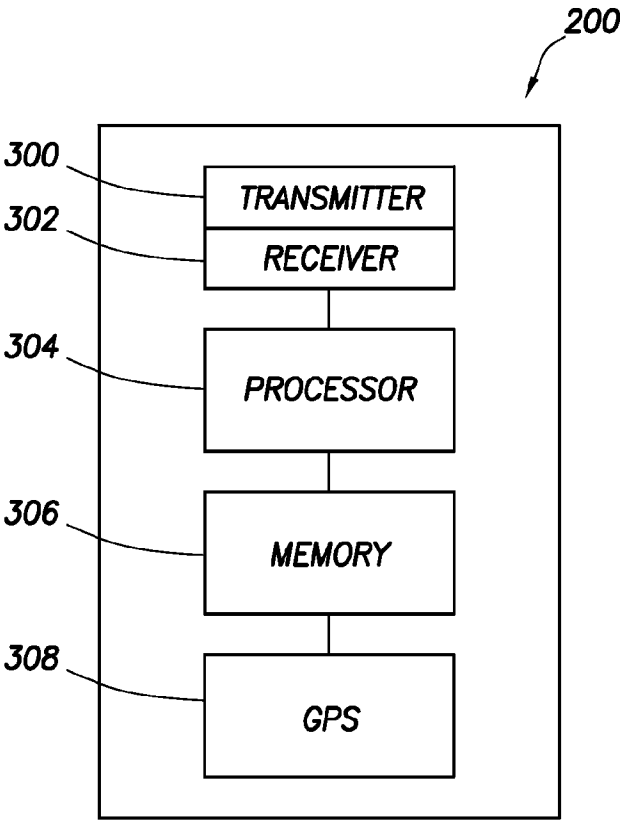
FIG. 3 is a schematic view of an embodiment of a modem usable in the downhole interface of FIGS. 2A and 2B.

The surface modem 200 is shown in greater detail in FIG. 3. The modem may be analog or digital. The modem includes a transmitter 300, a receiver 302, a processor 304 and a memory unit 306. The transmitter and receiver may be in the form of an analog or digital transceiver. The transmitter is provided to transmit data received by the receiver from the downhole unit to the surface unit. The transmitter may also be used to transmit commands received from the surface unit by the receiver to the downhole tool. Diagnostic signals may also be transmitted from the interface sub to the downhole tool and/or surface unit. For diagnostics, signals from the downhole tools/surface units can be looped back to the downhole tools/surface units, respectively.

The processor 304 of the modem is used to modulate and demodulate signals received from the downhole tool and/or surface unit for conversion so that they may be received by the downhole tool and surface unit. Error corrections, detection, compression, encryption and other data manipulation may be performed. The modulation scheme for the interface is preferably set at a baud rate capable of communicating between the surface unit and the downhole tool. The baud rates of corresponding modems for the surface unit and interface are provided with aligned baud rates. Similarly, the baud rates of the corresponding modems for the downhole tool and the uphole interface are aligned.

The memory unit 306 is provided to store data for future use. Sensor or diagnostic data, for example, may be stored.

Other items, such as a global positioning system 308, may also be provided to perform additional functions, such as setting a real time clock, or for time synchronization between uphole surface and downhole tools/surface units. Additionally, an analog front end (amplifiers, filters, etc.) may also be required.

Referring now to FIG. 2B, a downhole interface 140 is depicted. The downhole interface is positioned between the WDP telemetry system and the downhole tool for communication therebetween. In some cases, a separate downhole interface may not be necessary, where the downhole tool is provided with an internal interface. Such an internal interface is made up of existing modems, processors, sensors and other features in the current downhole tool.

The downhole interface 140 may be the same as the uphole interface, except that the downhole interface is provided with a WDP downhole modem 320, a downhole modem 322, a WDP connector 324 and a downhole tool connector 326. The downhole interface provides a communication link between the uphole interface and the downhole interface. The downhole modem provides a communication link between the WDP telemetry system and one or more components in the downhole tool. Additionally, a downhole connector 326 will be provided in place of the surface connector. The downhole connector may be wired or wireless and provide an inductive, conductive or optical connection between the WDP telemetry and the downhole tool. The WDP connector 324 operatively connects the downhole interface to the wired drill pipe telemetry system.

Communication between the interface(s) and the downhole tool and/or surface unit is performed according to a protocol. The protocol defines the format and sequence for signals that are sent and received by the interface. The protocol may be, for example, a predefined set of rules that establish the communication scheme between corresponding modems. The protocol may be selectively adjusted to conform to the requirements of a given telemetry system. Alternatively, a given telemetry system may be adapted to conform to the protocol of the interface. The protocol and/or baud rates for the downhole interface may be adjusted to the uphole interface, and the protocol and/or baud rates for the uphole interface may also be adjusted to the downhole interface.

FIG. 4 schematically depicts a variety of possible configurations utilizing one or more interfaces. The interfaces may be positioned at a variety of locations along the wellsite. For example, one of the uphole interface may be positioned adjacent the top drive, and another located further downhole. In another example, one downhole interface may be positioned adjacent the wired drill pipe telemetry system, and another interface positioned further downhole along the downhole tool.

Figure 4D:
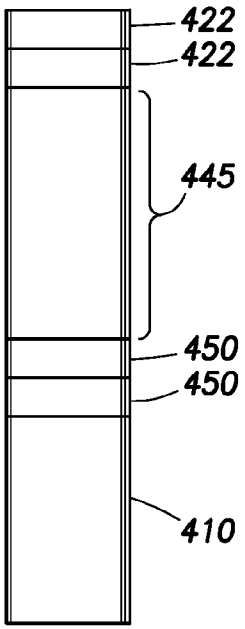
FIGS. 4A-D are schematic views of various configurations of interfaces used in combination with wired drill pipe telemetry systems and downhole tools.
Figure 4C:
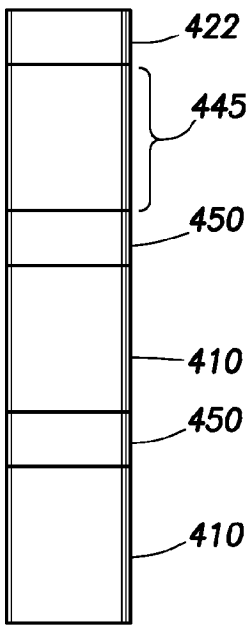
Figure 4B:
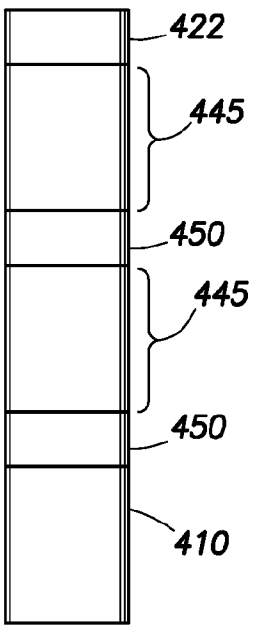
Figure 4A:
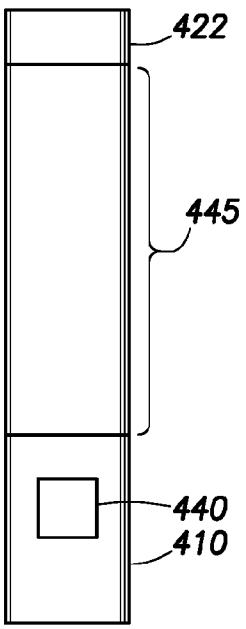

FIG. 4A shows a wired drill pipe telemetry system 445 directly connected to a downhole tool 410. An uphole interface 422 is positioned above the wired drill pipe telemetry system. A downhole interface 440 is integral to the downhole tool 410. In this situation, the downhole interface may be formed from existing portions of the downhole tool, such as processors, modems and other devices that form portions of the components of the downhole tool.

FIG. 4B depicts multiple wired drill pipe telemetry systems 445, each having its own downhole interface 450. An uphole interface 422 is provided at an uphole end of the upper most wired drill pipe telemetry system. The downhole interfaces 450 can communicate simultaneously or independently with the downhole tool 410.

FIG. 4C depicts multiple downhole tools, each having its own downhole interface 450. An uphole interface 422 is provided at an uphole end of the wired drill pipe telemetry system. FIG. 4D depicts a wired drill pipe telemetry system having multiple uphole interfaces 422 and multiple downhole interfaces 450.

Figure 5A:
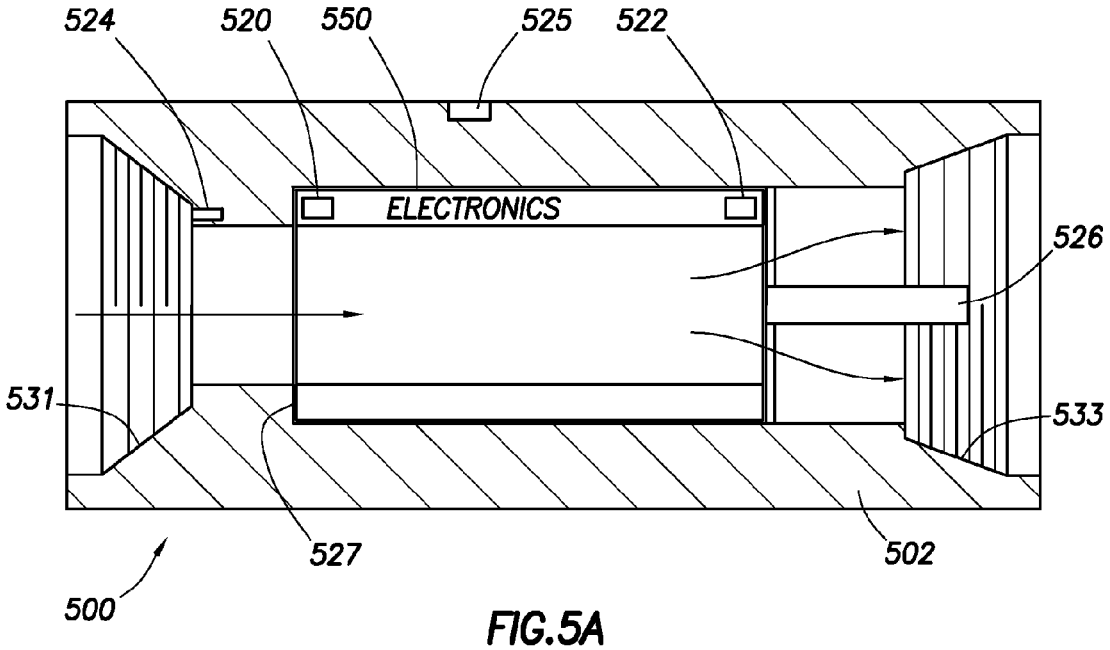
FIGS. 5A and 5B are cross-sectional views of embodiments of the interface of the invention.

FIG. 5A depicts an example of an interface 500 for use between a wired drill pipe system, such as the wired drill pipe system 145 of FIG. 1 and a downhole tool or bottom hole assembly, such as the BHA 100 of FIG. 1. The interface 500 includes a housing 502, a WDP connector 524, a downhole connector 526 and electronics 550. As shown, the electronics are positioned on an inner surface of the drill collar to permit the flow of mud therethrough as indicated by the arrows. The electronics are preferably removably loaded into the drill collar and mounted against a shoulder 527.

The housing may be a drill collar or other tubing or sub connectable to the WDP system and/or downhole tool. Alternatively, the housing may be part of the WDP system and/or downhole tool. Preferably the ends 531 and 533 are threadably connected to corresponding drill pipes of the WDP system and/or downhole tool. As shown, ends 531 and 533 are box ends provided with mating internal threads adapted to threadably engage an adjacent drill pipe for operative connection therewith. The ends may optionally be box or pin ends as necessary to mate with adjacent collars. One or more such interface 500 may be connected together or separated by additional drill collars. The interface may be inverted, so long as the operative connections are mated to their respective tools.

The WDP connector 524 and the downhole connector 526 operatively connect the interface to the WDP system and the downhole tool, respectively. The electronics 550 are used to pass signals between the WDP system and the downhole tool. The electronics contain a WDP modem 520 and a downhole modem 522. Additional electronics may also be included, such as the electronics shown in FIGS. 2A, 2B and 3. FIGS. 7A-9 illustrate additional configurations for the electronics as will be described further below.

As shown in FIG. 5A, additional features, such as a read out port 525 may also be provided. The read out port provides access to the electronics. For example, when the tool is retrieved to the surface, a surface unit may be plugged into the readout port to retrieve data, insert commands, terminate power or perform other procedures.

Figure 5B:
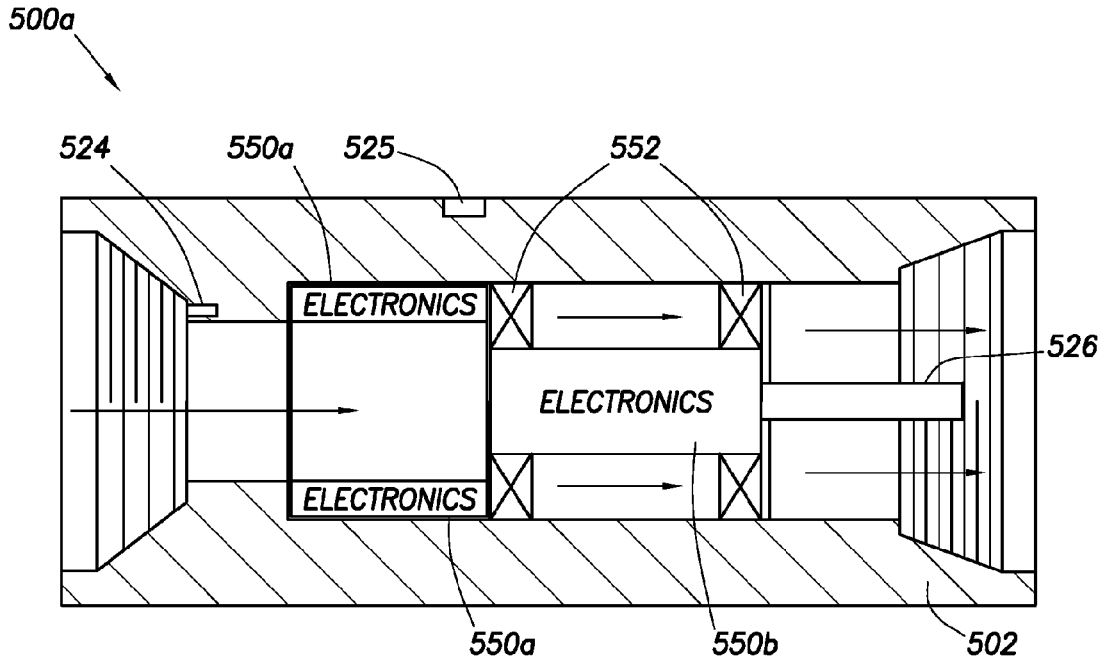

FIG. 5B depicts an interface 500*a* with a partially annular and partially mandrel style configuration. Interface 500*a* is essentially the same as FIG. 5A, except that a portion of the electronics is positioned in a mandrel layout. In other words, a portion of the electronics 550*a* are positioned along the inner surface of housing 502 as shown in FIG. 5A, and another portion of the electronics 550*b* are positioned in a mandrel configuration within the housing. Centralizers 552 are positioned along the inner surface of the housing to support the electronics 550*b*, and have apertures therethrough to permit the passage of drilling mud as indicated by the arrows.

Figure 6A:
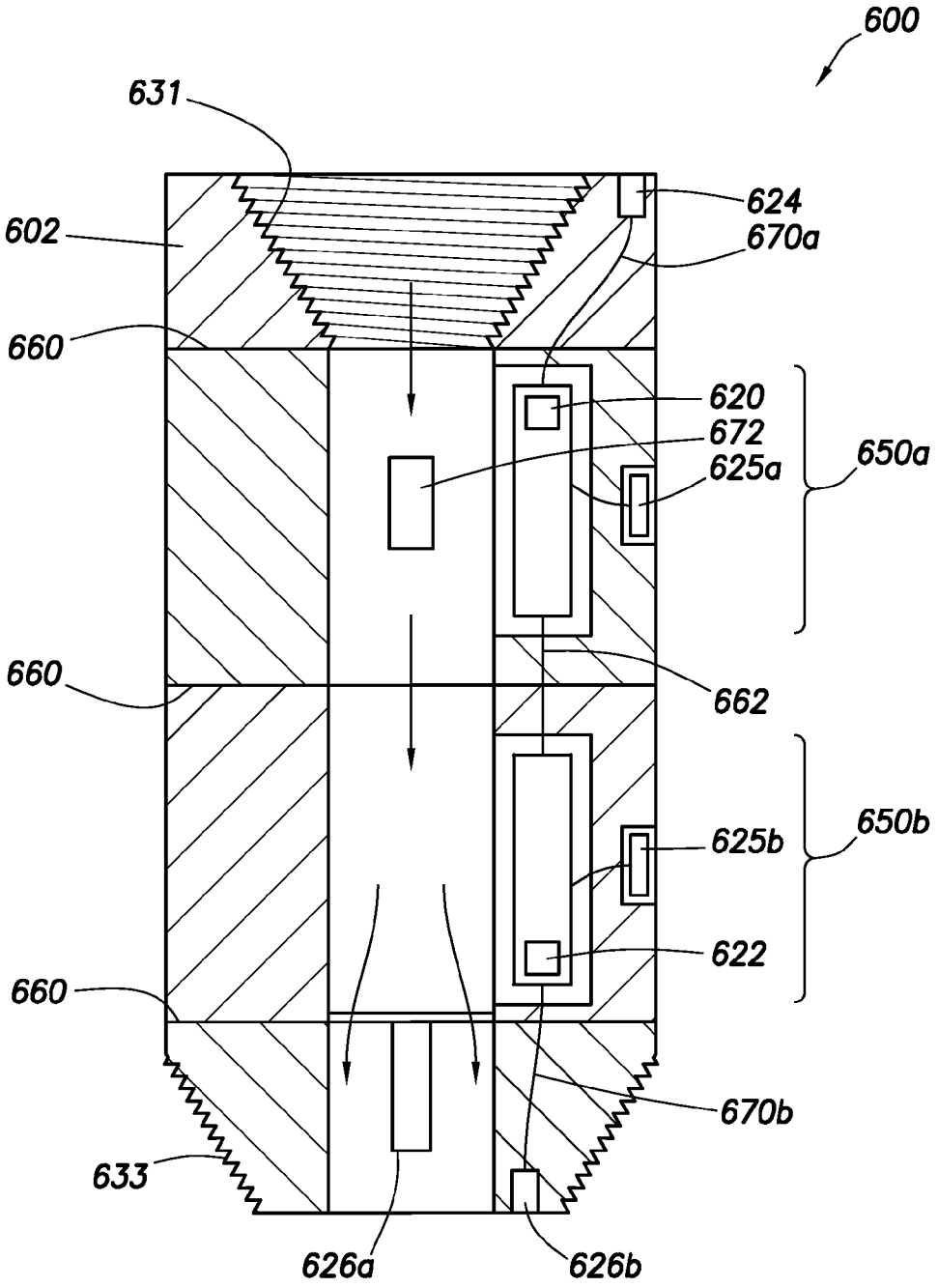
FIGS. 6A and 6B are cross-sectional views of modularized interfaces in accordance with embodiments of the invention.

FIGS. 6A-D depict various configurations of a modular interface for use between a wired drill pipe system, such as the wired drill pipe system 145 of FIG. 1 and a downhole tool or bottom hole assembly, such as the BHA 100 of FIG. 1. As shown in FIG. 6A, the modular interface 600 includes a housing 602, a WDP connector 624, downhole connectors 626*a*, 626*b*, and electronics 650*a*, 650*b*. As shown, the electronics are positioned on an inner surface of the drill collar to permit the flow of mud therethrough as indicated by the arrows. The electronics are preferably removably loaded into the drill collar and mounted on along an inner surface thereof.

The housing may be the same as in FIG. 5A. As shown in FIG. 6A, uphole end 631 is a box end, and downhole end 633 is a pin end with threadable connections for operatively connecting to their respective tools.

The housing may be provided with one or more connections 660. The connections 660 provide modularity for the interface 600. Portions of the interface may be selectively connected or separated. The connections may be for example, shop joint, threaded, soldered, welded, or other joints that operatively connect portions of the interface. The connections permit separation of the interface as necessary, for example for maintenance or machining. For example, where a WDP system is developed by a first entity, the first entity may develop a WDP portion of the related interface, and where the downhole tool is developed by a second entity, that second entity may develop the downhole portion of the interface. In this manner, the interface may be separately manufactured and then jointly assembled. Electronics 650*a*, 650*b* are preferably positioned in separate modules to permit separate assembly. While two sets of electronics are depicted, additional modules with additional electronics may be provided.

One or more connectors, such as link 662, may be used to operatively connect the electronics 650*a* and 650*b*. Links 670*a* and 670*b* are provided to operatively connect the electronics 650*a* to WDP connector 624 and electronics 650*b* to downhole connector 626*b*, respectively. The connections, links, read out ports or other devices may communicate via wired, wireless, or any type of connector that permits an operative connection. Where such connections extend across a connection 660, an additional joint may be used.

The WDP connector 624 and the downhole connector 626*a* may be the same as the connectors 524, 526, respectively. Optionally, an additional or alternative downhole connector 626*b* may be used, such as an inductive or conductive connector operatively connectable to the downhole tool. The electronics 650*a*, 650*b* are used to pass signals between the WDP system and the downhole tool. The electronics 650*a* and 650*b* are depicted as having a WDP modem 620 and a downhole modem 622, respectively to enable communication therethrough. Connectors, such as 624, 626*a* and 626*b* may be positioned at various locations within the interface, so long as an operative connection is provided.

Additional electronics may also be included, such as the electronics shown in FIGS. 2A, 2B and 3. FIGS. 7A-9 describe additional configurations for the electronics as will be described further below. As shown in FIG. 6A, read out ports 625*a, b* may also be provided with read out circuitry positioned therein. For example, such read out circuitry may include sensors and other electronics, such as those shown in FIGS. 7A-9 and described further herein. The read out ports 625*a*, 625*b* may be the same as the read out port 525 of FIG. 5A, except that circuitry may be provided therein to facilitate connections and signal transfers.

As shown in FIG. 6A, one or more additional components 672 may be positioned in the interface to perform a variety of additional functions. For example, the component may be used to perform a variety of downhole operations, such as downhole sensing (ie. pressure), power generation, telemetry, memory or other operations.

Figure 6B:
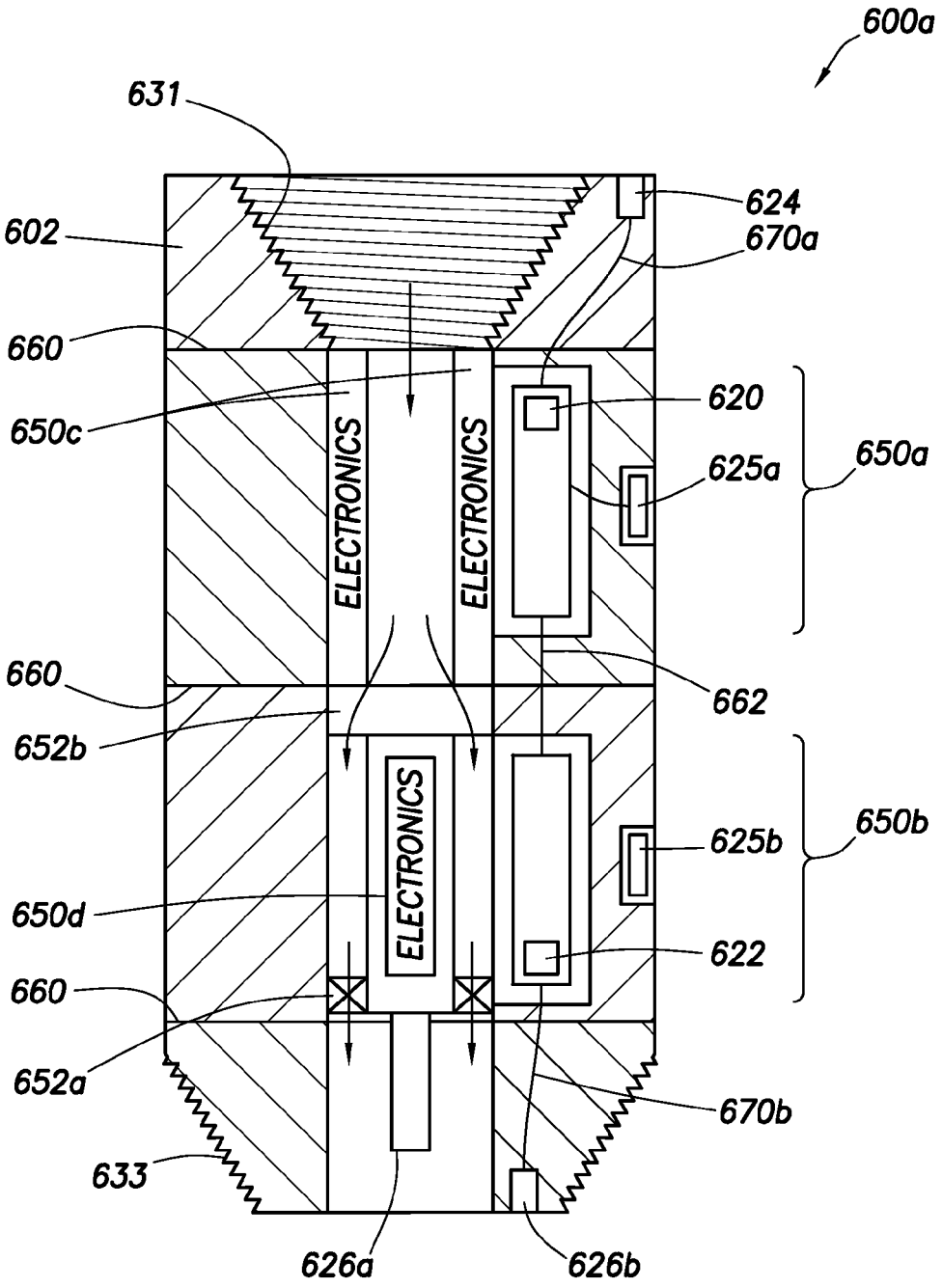

FIG. 6B shows an alternate configuration of a modular interface 600*a* is the same as the modular interface 600*a* of FIG. 6A, except that additional electronics 650*c* and 650*d* are provided. As shown electronics 650*c* are additional electronics positioned in an annular position along the inner surface of the housing 602 adjacent the electronics 650*a*. Electronics 650*d* are supported on centralizers 652 in a mandrel position within the housing. In this configuration, the modular connection may be separate along connection 660 such that a first portion of the interface contains electronics 650*a* and 650*c*, and a second portion contains electronics 650*b* and 650*d*. Additional connections 660 may be provided to permit additional separations, for example for threaded end 631 with coupler 624 and threaded end 633 with downhole connector 626*b*.

Figure 6D:
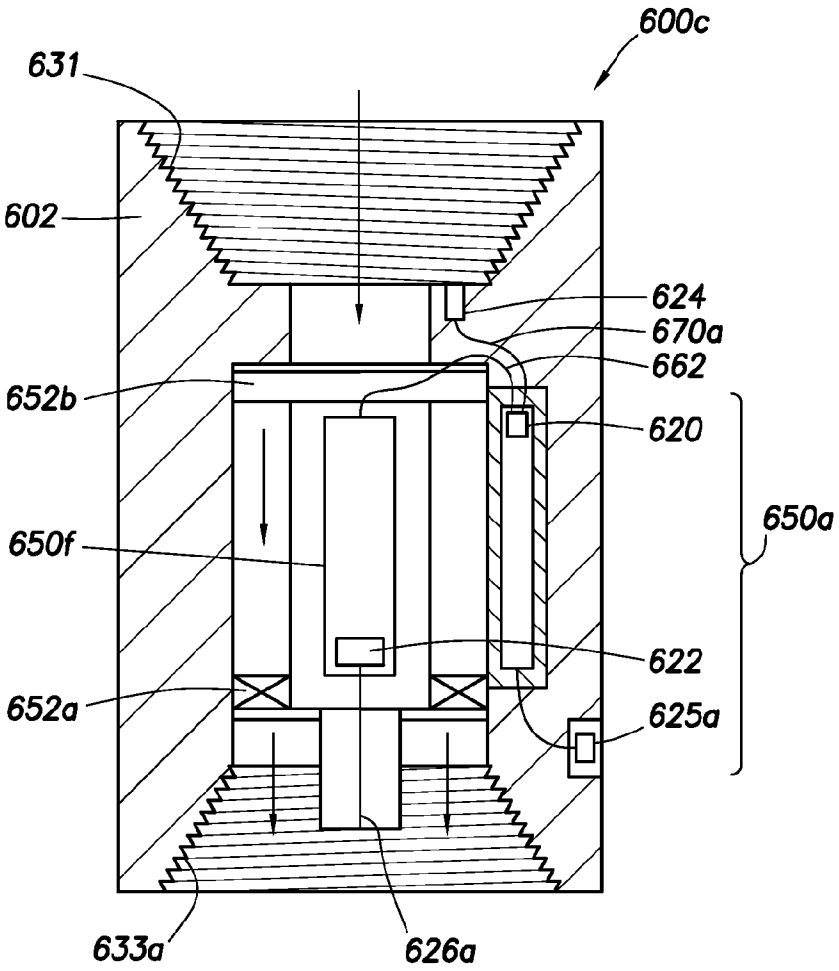
FIGS. 6C and 6D are cross-sectional views of interfaces in accordance with further embodiments of the invention.
Figure 6C:
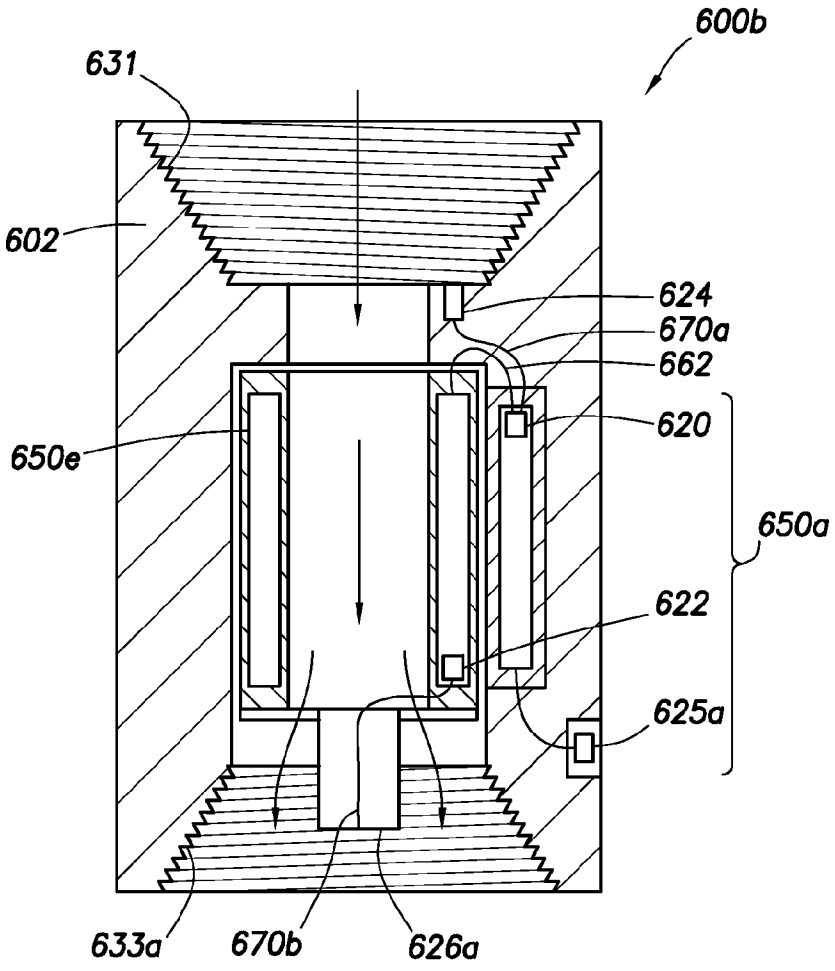

FIG. 6C shows an alternate modular interface 600*b*. In this configuration, electronics 650*a* are positioned along the inner surface, and electronics 650*e* is positioned on an inner surface of the housing adjacent electronics 650*a*. Electronics 650*a* is provided with WDP modem 620, and electronics 650*e* is provided with downhole modem 622. Preferably, electronics 650*e* are removably positioned within the drill collar. In this manner, the electronics 650*e* may be separated from the interface for separate maintenance, installation, etc.

As shown in FIG. 6C, the housing has a first box end 631, and a pin end 633*a*. As described above, the ends may be box and/or pin or other connections capable of operatively connecting the interface with the drill string and/or downhole tool.

FIG. 6D shows an alternate modular interface 600*c*. The modular interface 600*c* may be the same as the modular interface 600*b* of FIG. 6C, except that the electronics 650*e* is replaced with electronics 650*f* in a mandrel configuration. Downhole modem 622 is positioned in electronics 650*f* for communication with the downhole tool.

Centralizers 652*a*, 652*b* are provided to support the electronics 650*f* in the housing. Centralizer 652*a* may be, for example, supports positioned about the electronics. Centralizer 652*b* may be, for example, a ring or spider used to support the electronics.

While the configurations shown in FIGS. 5A-6D depict specific arrangements of electronics, connectors and other devices within a housing, it will be appreciated that these arrangements may be varied. For example, WDP connectors and modems may be positioned in various locations about the housing.

Figure 7A:
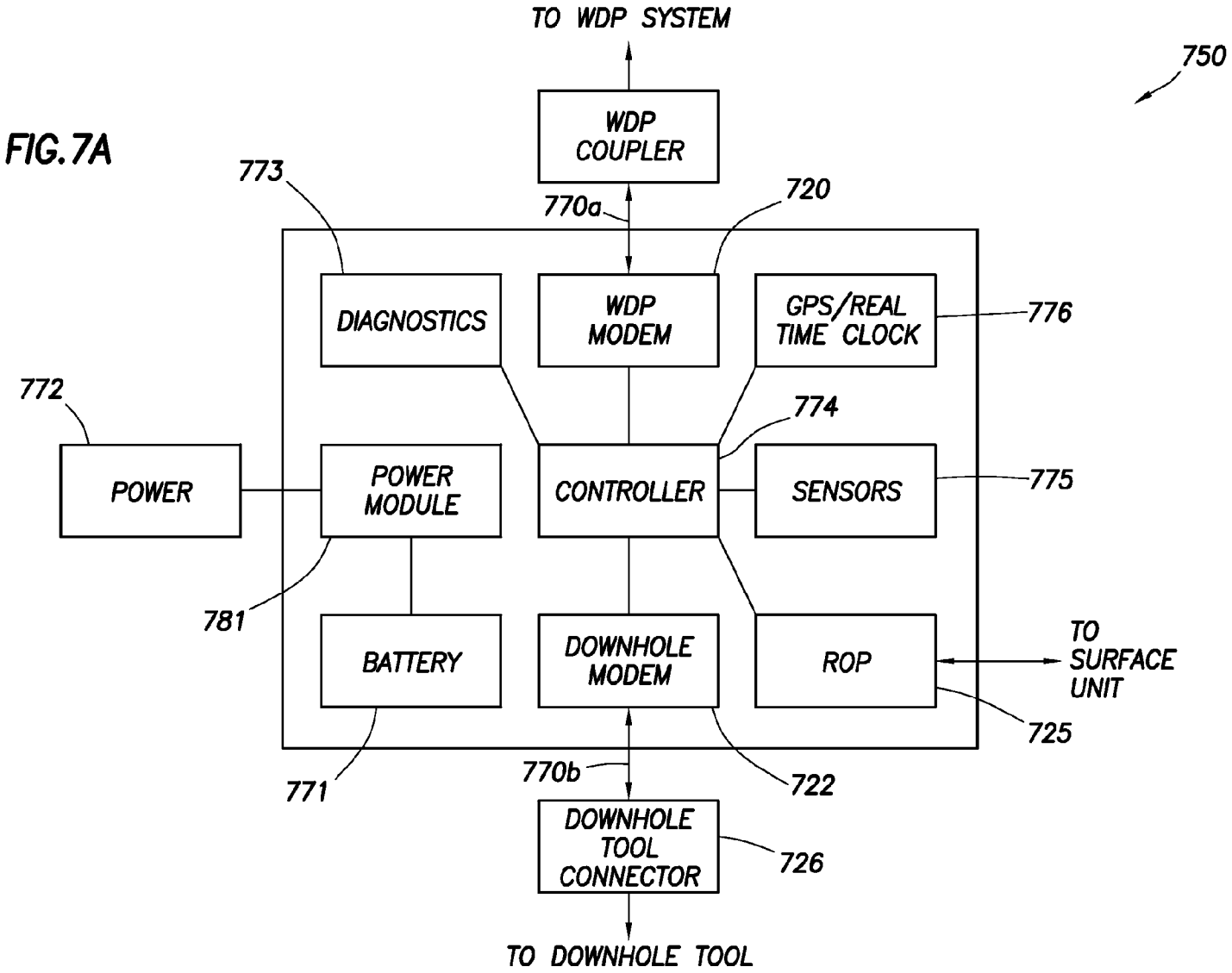
FIGS. 7A-7C are schematic diagrams, in block form, of the electronics used in embodiments of the interfaces of the invention.
Figure 7B:
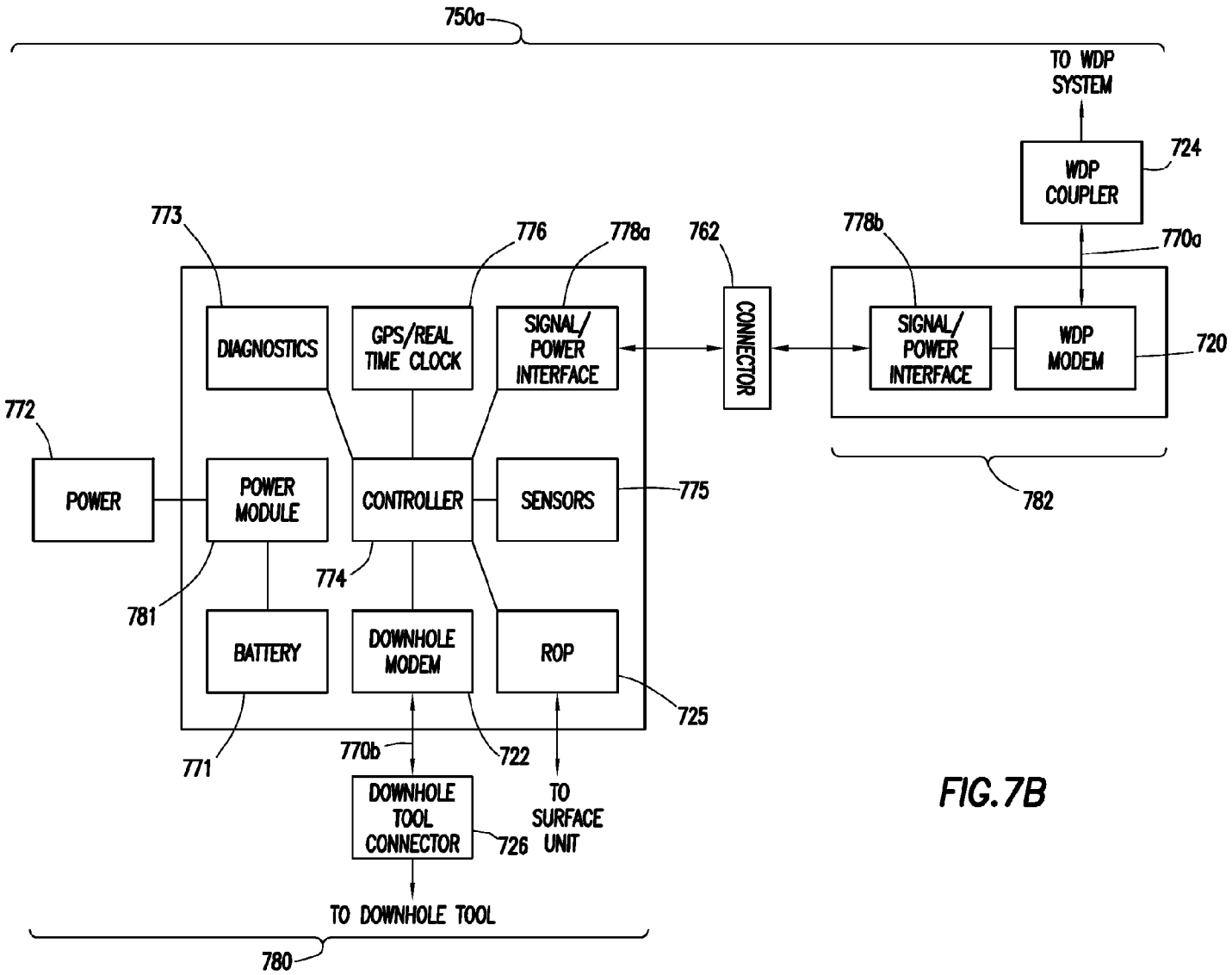
Figure 7C:
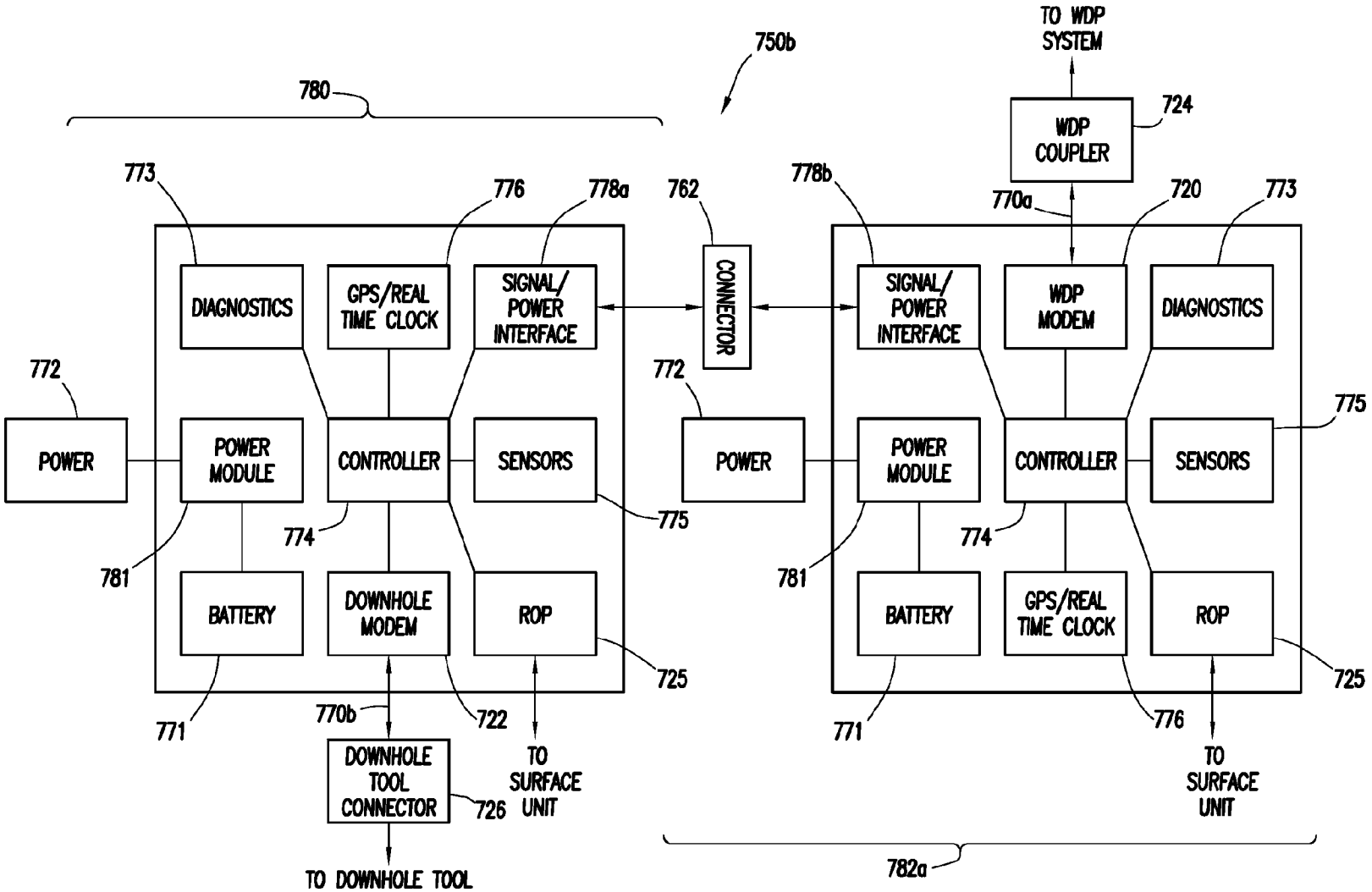

FIGS. 7A-C are schematic diagrams depicting a detailed view of the electronics 750 usable with the interfaces provided herein. As shown, the electronics include a WDP modem 720, a downhole modem 722 and power module 781. As shown, power may be provided internally using power module 781 and/or battery 771 and/or external power source 772. Additional electronics may also be provided, such as diagnostics 773, controller 774, sensors 775, GPS/real time clock 776 and read out port (ROP) 725.

The controller may be used for processing signals, analyzing data, controlling the power supply and performing other downhole operations. The diagnostics may be used for monitoring the electronics, the downhole tool, the WDP system and other related systems. The sensors may be the same as the sensors 204 of FIG. 2B. The GPS/real time clock may be used, for example, to provide a time stamp for the data acquired from the sensor and time synchronization. The read out port may be the same as the read out port 625 described herein.

FIG. 7B depicts an alternate configuration for the electronics 750*a*. In this configuration, the electronics 750 of FIG. 7A are separated into a WDP portion 782, and a downhole portion 780 with a connector 762 therebetween. As shown, the electronics 780 are the same as the electronics 750 of FIG. 7A, except that the WDP modem 720 has been moved to the WDP portion 782, and a signal/power interface 778 is provided to operatively communicate with the WDP portion 782.

The WDP portion 782 is provided with the WDP modem 720 and a signal/power interface 778*b* that communicates with signal power interface 778*a* of the downhole portion 780. Connector 762 is optionally provided to operatively connect the upper and lower portions. In some cases, this may be a field joint or other type of connector capable of passing signals between the portions 780, 782. The connection may be, for example, inductive, conductive or optical and wired or wireless.

FIG. 7C depicts another configuration of electronics 750*b*. This configuration is the same as the electronics 750*a* of FIG. 7B, except that the WDP portion 782*a* is provided with additional electronics. The WDP portion 782*a* contains the WDP modem 720 and the signal power interface 778*b* (as with previous WDP portion 782 of FIG. 7B), plus power module 781, battery 771, GPS/real time clock 776, ROP 725, sensors 775, controller 774, diagnostics 773 an external power 772. This configuration shows that a variety of electronics may be used with the one or more portions of the electronics. While two portions are depicted, multiple portions containing various portions of the electronics may be provided. Connectors may be needed to join the respective electronics.

Figure 8:
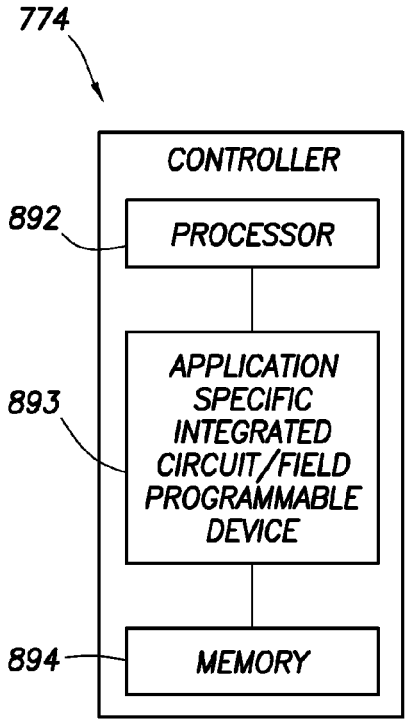
FIGS. 8 and 9 show block diagrams of a controller and modem, respectively, used in embodiments of the invention.
Figure 9:
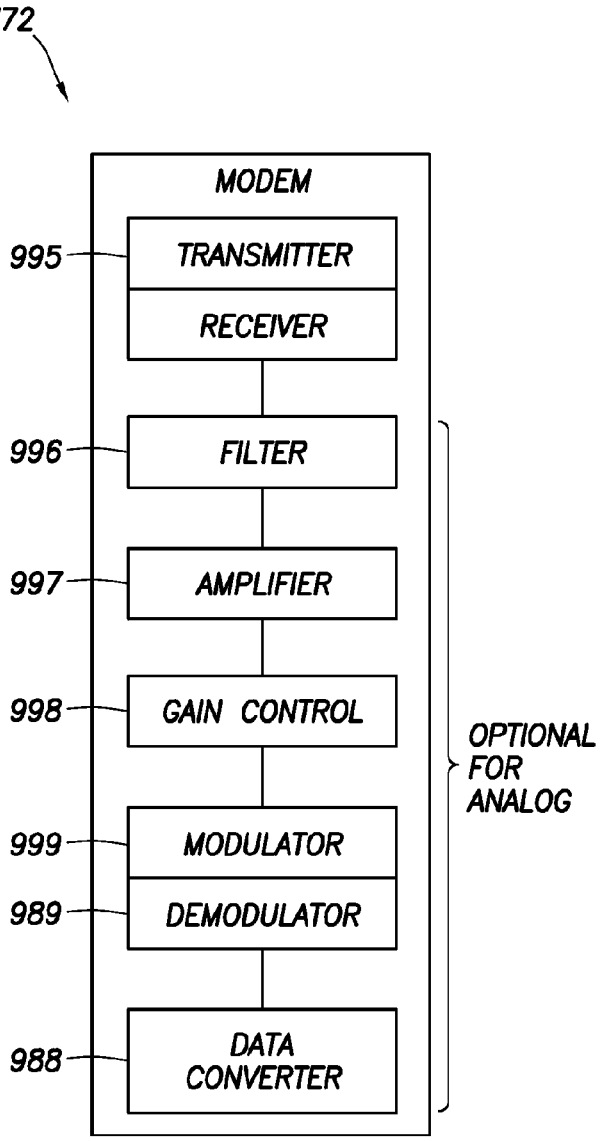

FIGS. 8 and 9 show an alternate configuration of the surface modem 200 of FIG. 3, split into separate portions. FIG. 8 is a detailed view of a controller 774. The controller may be provided with a processor 892, memory 894, Application Specific Integrated Circuit (ASIC)/Field Programmable Device (FPD) 893 and other circuitry.

FIG. 9 is a detailed view of downhole modem 772. The same configuration may be used for WDP modem 720. The modem may include, for example, a transmitter and receiver (or transceiver) 995. In cases where analog is used, the modem may also be provided with a filter 996, an amplifier 997, a gain control 998, a modulator 999, a demodulator 989 and a data converter 988.

The interfaces as shown in FIGS. 5A-6D may be positioned about a WDP system and/or downhole tool as shown in FIGS. 4A-4D. For example, the interfaces of FIGS. 5A-6D may be configured as surface interfaces, such as the interfaces 422 of FIGS. 4A-4D, integral interface 440 of FIG. 4A and/or downhole interfaces 450 of FIGS. 4B-4D. The interfaces as described herein may also be provided with one or more repeaters to amplify and/or reshape the signal. Repeaters and other devices, such as the modem depicted in FIG. 9, may be used to improve the signal as it is passed through the wellbore.

These configurations allow, among other things, flexibility in adapting to a variety of downhole tools and wired drill pipe telemetry systems. In addition to the figure depicted, various combinations of integral and separate interfaces may be used. Multiple integral interfaces may also be used.

It will be understood from the foregoing description that various modifications and changes may be made in the preferred and alternative embodiments of the present invention without departing from its true spirit. For example, the communication links described herein may be wired or wireless. The devices included herein may be manually and/or automatically activated to perform the desired operation. The activation may be performed as desired and/or based on data generated, conditions detected and/or analysis of results from downhole operations.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A system for providing communication in a borehole comprising:

a downhole tool positioned in the borehole;

at least one downhole interface comprising:

a housing having an inner annular surface defining a passage;

supports positioned along the inner surface of the housing and having apertures therethrough to permit the flow of fluid through the housing;

a downhole connector supported in the passage by the supports, and electronics removably mounted to the supports in the housing, the electronics being positionable in and in fluid communication with the passage a distance from the inner surface to permit the flow of fluid therebetween, the electronics being communicatively coupled via the downhole connector to the downhole tool; and a drill string communicatively coupled to the electronics of the at least one downhole interface via a second connector, the drill string comprising a plurality of wired drill pipes communicatively coupled, wherein the at least one downhole interface is positionable between the downhole tool and one of the plurality of wired drill pipes.

2. The system of claim 1 wherein the downhole tool is a logging while drilling tool.

3. The system of claim 1 wherein the downhole tool is a measurement while drilling tool.

4. The system of claim 1 wherein the downhole tool measures formation properties surrounding the borehole.

5. The system of claim 1 wherein the downhole tool is positioned within a bottom hole assembly.

6. The system of claim 1 wherein the downhole tool measures formation resistivity, natural radiation, density or pore pressure.

7. The system of claim 1 wherein the at least one downhole interface is integral with the downhole tool.

8. The system of claim 1 wherein the at least one downhole interface is directly connected to the downhole tool and one of the plurality of wired drill pipes.

9. The system of claim 1 wherein the fluid is a drilling fluid flowable through the at least one downhole interface.

10. The system of claim 1 wherein the at least one downhole interface includes electronics providing a power interface between one of the plurality of wired drill pipes and the downhole tool.

11. The system of claim 10 wherein the electronics provides a signal interface between one of the plurality of wired drill pipes and the downhole tool.

12. The system of claim 10 wherein the electronics comprises a battery.

13. The system of claim 1, wherein the at least one downhole interface is supportable by one of a wall of the housing, centralizer in a mandrel positioned within the housing, and combinations thereof.

14. The system of claim 1, wherein at least one of the downhole connector and the second connector is removably positionable in the housing.

15. The system of claim 1, wherein the downhole connector comprises a down hole modem operatively coupled to the plurality of wired drill pipes.

16. The system of claim 1, wherein at least a portion of the electronics is positioned along an annular portion of the passage.

17. The system of claim 1, wherein at least a portion of the electronics is positioned along a mandrel positionable within the passage of the downhole interface.

18. The system of claim 1, wherein the downhole connector is operatively connectable between portions of the downhole interface.

19. The system of claim 1, wherein the downhole component further comprises a centralizer for supporting the electronics therein.

20. The system of claim 1, wherein the housing is modular.

21. The system of claim 1, wherein the electronics is shaped to be mounted about the passage in the housing and has an opening for the flow of the fluid therethrough.

22. A system for providing communication in a borehole comprising:

a drill string comprising at least a portion of wired drill pipes communicatively coupled;

a bottom hole assembly communicatively coupled to one of the wired drill pipes, the bottom hole assembly comprising a downhole tool; and at least one downhole interface comprising:

a housing having an inner annular surface defining a passage;

supports positioned along the inner surface of the housing and having apertures therethrough to permit the flow of fluid through the housing;

a downhole connector supported in the passage by the supports; and electronics removably mounted to the supports in the housing, the electronics being positionable in and in fluid communication with the passage a distance from the inner surface to permit the flow of fluid therebetween, the electronics being coupled to one of the wired drill pipes via a second connector, coupled to the bottom hole assembly via the downhole connector, and positionable between the bottom hole assembly and one of the wired drill pipes, wherein the at least one downhole interface provides communication between the bottom hole assembly and the wired drill pipes.

23. The system of claim 22 wherein the downhole tool measures formation properties proximate the borehole.

24. The system of claim 22 wherein the downhole tool measures resistivity of a formation surrounding the borehole.

25. The system of claim 22 wherein the downhole tool measures natural radiation of a formation surrounding the borehole.

26. The system of claim 22 wherein the downhole tool measures pore pressure of a formation surrounding the borehole.

27. The system of claim 22 wherein the bottom hole assembly includes a measurement while drilling tool.

28. The system of claim 22 wherein the bottom hole assembly includes a logging while drilling tool.

29. The system of claim 22 wherein the at least one downhole interface provides power to the downhole tool.

30. The system of claim 22, wherein the electronics is shaped to be mounted about the passage in the housing and has an opening for the flow of the fluid therethrough.

31. A method of communicating in a borehole comprising:

providing at least one downhole interface comprising:

a housing having an inner annular surface defining a passage;

supports positioned along the inner surface of the housing and having apertures therethrough to permit the flow of fluid through the housing;

a downhole connector supported in the passage by the supports, and electronics removably mounted to the supports in the housing, the electronics being removably positionable in and in fluid communication with the passage about the inner annular surface a distance from the inner surface to permit the flow of fluid therebetween;

communicatively connecting the electronics of the at least one downhole interface directly to a downhole tool via the downhole connector;

communicatively connecting the electronics of the at least one downhole interface directly to one of a plurality of wired drill pipes via a second connector, communicatively coupled together such that the at least one downhole interface is positionable between the downhole tool and one of the plurality of wired drill pipes;

conducting a measurement of a formation surrounding the borehole with the downhole tool;

communicating the measurement from the downhole tool to the at least one downhole interface; and transmitting the measurement from the at least one downhole interface to the wired drill pipes.

32. The method of claim 31 wherein the measurement relates to one or more properties of a formation surrounding the borehole.

33. The method of claim 32 wherein the measurement relates to resistivity of the formation.

34. The method of claim 32 wherein the measurement relates to density of the formation.

35. The method of claim 31 wherein the downhole tool is a logging while drilling tool.

36. The method of claim 31 wherein the downhole tool is a measurement while drilling tool.

37. The method of claim 31 further comprising providing power from the at least one downhole interface to the downhole tool.

38. The method of claim 31 further comprising flowing drilling fluid through the plurality of wired drill pipes and the at least one downhole interface.

39. The method of claim 31, wherein the electronics is shaped to be mounted about the passage in the housing and has an opening for the flow of the fluid therethrough.

40. A system for providing communication in a borehole, comprising;

a wired, jointed pipe string disposed in a borehole;

at least one downhole interface comprising:

a housing having an inner annular surface defining a passage;

supports positioned along the inner surface of the housing and having apertures therethrough to permit the flow of fluid through the housing;

a downhole connector supported in the passage by the supports, and electronics removably mounted to the supports in the housing, the electronics being positionable in and in fluid communication with the passage a distance from the inner surface to permit the flow of fluid therebetween, the electronics being communicatively coupled via a second connector to the wired, jointed pipe string; and at least one downhole production tool communicatively linked to the electronics of the at least one downhole interface so as to communicate a signal from the at least one downhole production tool over a communication channel in the wired pipe string.

41. The system of claim 40, wherein the electronics is shaped to be mounted about the passage in the housing and has an opening for the flow of the fluid therethrough.

* * * * *